US007962231B2

(12) United States Patent
Reichelt et al.

(10) Patent No.: US 7,962,231 B2
(45) **Date of Patent: *Jun. 14, 2011**

(54) APPARATUS AND METHOD FOR PROVIDING DATA IN A MULTI-RENDERER SYSTEM

(75) Inventors: Katrin Reichelt, Dresden (DE); Gabriel Gatzsche, Martinroeda (DE); Thomas Heimrich, Kuehndorf (DE); Kai-Uwe Sattler, Ilmenau (DE); Sandra Brix, Ilmenau (DE)

(73) Assignees: Fraunhofer-Gesellschaft zur Foerderung der angewandten Forschung e.V., Munich (DE); Tu Ilmenau, Ilmenau (DE)

( * ) Notice: Subject to any disclaimer, the term of this patent is extended or adjusted under 35 U.S.C. 154(b) by 938 days.

This patent is subject to a terminal disclaimer.

(21) Appl. No.: 11/840,333

(22) Filed: Aug. 17, 2007

(65) Prior Publication Data

US 2008/0019534 A1 Jan. 24, 2008

Related U.S. Application Data

(63) Continuation of application No. PCT/EP2006/001412, filed on Feb. 16, 2006.

(30) Foreign Application Priority Data

Feb. 23, 2005 (DE) ..... 10 2005 008 343

(51) Int. Cl.

| | |
|---|---|
| ***H04R 17/00*** | (2006.01) |
| ***H04R 5/00*** | (2006.01) |
| ***H04R 1/02*** | (2006.01) |
| ***H04R 29/00*** | (2006.01) |

(52) U.S. Cl. ..... 700/94; 381/18; 381/58; 381/89

(58) Field of Classification Search ..... 381/17–19, 381/59, 66, 89, 123, 310; 700/94
See application file for complete search history.

(56) References Cited

U.S. PATENT DOCUMENTS 6,572,475 B1 6/2003 Okabe et al.

(Continued)

FOREIGN PATENT DOCUMENTS

DE 102 15 775 10/2003

(Continued)

OTHER PUBLICATIONS

Verheijen, Edwin, "Sound Reproduction by Wave Field Synthesis", 1998, Technische Universiteit Delft, pp. 37-47 and 83-112.*

(Continued)

*Primary Examiner* — Curtis Kuntz
*Assistant Examiner* — Jesse A Elbin
(74) *Attorney, Agent, or Firm* — Keating & Bennett, LLP

(57) ABSTRACT

An apparatus for providing data for wave field synthesis rendering in a wave field synthesis system with plurality of renderer modules, at least one loudspeaker being associated with each renderer module, and the loudspeakers associated with the renderer modules being attachable at different positions in a reproduction room, includes a provider for providing a plurality of audio files, wherein a virtual source at a source position is associated with an audio file, and a data output for providing the audio file to a renderer with which an active loudspeaker is associated, with the data output further formed to not provide the audio file to a renderer if all loudspeakers associated with the renderer are not to be active for the reproduction of the source. Thus, unnecessary data transmissions in the wave field synthesis system are avoided, while making optimum use of the renderer maximum capacity in a multi-renderer system.

16 Claims, 6 Drawing Sheets

U.S. PATENT DOCUMENTS

| | | | |
|---|---|---|---|
| 7,027,600 | B1 | 4/2006 | Kaji et al. |
| 2001/0012368 | A1 | 8/2001 | Yamazaki |
| 2003/0118192 | A1 | 6/2003 | Sasaki |
| 2005/0105442 | A1 | 5/2005 | Melchior et al. |
| 2005/0175197 | A1 | 8/2005 | Melchior et al. |
| 2006/0092854 | A1 | 5/2006 | Roder et al. |
| 2006/0109992 | A1 | 5/2006 | Roeder et al. |
| 2006/0165238 | A1 | 7/2006 | Spille et al. |

FOREIGN PATENT DOCUMENTS

| | | | |
|---|---|---|---|
| JP | 07-303148 | A | 11/1995 |
| JP | 10-211358 | A | 8/1998 |
| JP | 11-027800 | A | 1/1999 |
| JP | 2000-267675 | A | 9/2000 |
| JP | 2002-199500 | A1 | 7/2002 |
| JP | 2003-284196 | A | 10/2003 |
| JP | 2004-007211 | A | 1/2004 |
| JP | 2004-258765 | A | 9/2004 |
| WO | 2004/036955 | A1 | 4/2004 |
| WO | 2004/051624 | A2 | 6/2004 |
| WO | 2004/103022 | A2 | 11/2004 |
| WO | 2004/103024 | A1 | 11/2004 |
| WO | 2004/114725 | A1 | 12/2004 |

OTHER PUBLICATIONS

Official communication issued in counterpart German Application No. 10 2005 008 343.9, mailed on Oct. 30, 2007.

Theile et al.: "Neue Moglichkeiten Der Raumlichen Tonaufnahme Und -Wiedergabe," Fernseh- und Kinotechnik Part 1 pp. 735-739, [http://web.archive.org/web/20050207002538/http://www.irt.de.wittek/hauptmikrofon/FKT__Theile__Wittek__Reisinger-1.pdf] Apr. 2003; Part 2 pp. 1-4, [http://web.archive.org/web/20050207002538/http://www.irt.de/wittek/hauptmikrofon/FKT__Theile__Wittek__Reisinger-II.pdf].

Bangert: "Die Auswirkungen Der Wellenfeldsynthese Auf Den Kinoton," SAE Institute Cologne, Feb. 13, 2004, [http://bangscape.de/trash/DA__Bangert__WFS.pdf].

Huber: "Zur Lokalisation Akustischer Objekte Bei Wellenfeldsynthese," IRT 2002; pp. 1-72; [http:/web.archive.org/web/20040708232729/www.irt.de/wittek/hauptmikrofon/DA__Huber.pdf].

Wittek: "Raumliche Wahrnehmung Von Virtuellen Quellen Bei Wellenfeldsynthese," 23 rd. Sound Master Conference, Leipzig, Nov. 6, 2004; [http://www.hauptmikrofon.de/HW/Wittek__TMT2004__Paper__final.pdf][research of Oct. 30, 2007].

Scheirer et al., "Audiobifs: Describing Audio Scenes With the MPEG-4 Multimedia Standard," IEEE Transactions on Multimedia, vol. 1, No. 3, Sep. 1999, pp. 237-250.

Official communication issued in the counterpart International Application No. PCT/EP2006/001412, mailed on Jun. 7, 2006.

Melchior et al.; "Authoring System for Wave Field Synthesis Content Production," AES Convention Paper 5972, 115th Convention, AES Meeting; Oct. 10-13, 2003; pp. 1-10.

Berkhout et al.; "Acoustic Control by Wave Field Synthesis," Journal of the Acoustical Society of America, AIP/Acoustical Society of America, vol. 93, No. 5, pp. 2764-2778; NY, US; May 1993.

Berkhout, A J: "A Holographic Approach to Acoustic Control" Journal of the Audio Engineering Society, Audio Engineering Society, vol. 36, No. 12, pp. 977-995, Dec. 1988.

Sonic Emotion AG; "Wellenfeldsynthese—Technologie Und Anwendungen Im Ueberblick," Internet Article, URL: http://web.archive.org/web/20050210095616/http://www.sonicemotion.com/cms/docs/WFS-technolgoy__1004__deutsch.pdf>; Feb. 10, 2005; XP002379466.

Sonic Emotion AG; "Zsonic Modules Sound Solutions for OEM Licensing," Internet Article, URL: http//web.archive.org/web/20050210095827/http://www.sonicemotion.com/cms/docs/zsonic__modules__product__overview__OEM.pdf>; Feb. 10, 2005; XP002379467.

Sonic Emotion AG; "Zsonic Modules Professional Sound Solutions," Internet Article, URL: http//web.archive.org/web/20050210095616/http://www.sonicemotion.com/cms/docs/zsonic__modules__product __info.pdf>: Mar. 19, 2005; XP002379468.

Reichelt et al., "Apparatus and Method for Controlling a Wave Field Synthesis Renderer Means With Audio Objects," U.S. Appl. No. 11/837,099, filed Aug. 10, 2007.

Reichelt et al., "Apparatus and Method for Simulating a Wave Field Synthesis System," U.S. Appl. No. 11/837,105, filed Aug. 10, 2007.

Reichelt et al., "Apparatus and Method for Controlling a Wave Field Synthesis Rendering Means," U.S. Appl. No. 11/840,327, filed Aug. 17, 2007.

Reichelt et al.; "Apparatus and Method for Storing Audio Files," U.S. Appl. No. 11/837,109, filed Aug. 10, 2007.

Office Action issued in U.S. Appl. No. 11/837,099, mailed on Oct. 22, 2009.

Seo et al., "Implementation of Interactive 3D Audio Using MPEG-4 Multimedia Standards," Oct. 2003, Audio Engineering Society, Convention Paper 5980, pp. 1-6.

Official Communication issued in corresponding Japanese Patent Application No. 2007-556536, mailed on Jun. 29, 2010.

* cited by examiner

| | Q1 | Q2 | Q3 | Q4 | Q5 | Q6 | Q7 | Q8 | Q9 |
|---|---|---|---|---|---|---|---|---|---|
| A1 | A | NA | NA | NA | A | NA | A | NA | A |
| A2 | NA | A | NA | NA | A | A | A | NA | A/NA |
| A3 | NA | NA | A | NA | NA | A | A | A | NA |
| A4 | NA | NA | NA | A | NA | NA | A | A | NA |

A: ACTIVE
NA: NON-ACTIVE
A/NA: DEPENDING ON UTILIZATION

Q2: NO COMPONENT
PARALLEL TO THE MED
-> ARRAY A1 NOT ACTIVE

APPARATUS AND METHOD FOR PROVIDING DATA IN A MULTI-RENDERER SYSTEM

CROSS-REFERENCE TO RELATED APPLICATIONS

This application is a continuation of copending International Application No. PCT/EP2006/001412, filed Feb. 16, 2006, which designated the United States and was not published in English.

BACKGROUND OF THE INVENTION

1. Field of the Invention

The present invention relates to wave field synthesis concepts, and particularly to an efficient wave field synthesis concept in connection with a multi-renderer system.

2. Description of the Related Art

There is an increasing need for new technologies and innovative products in the area of entertainment electronics. It is an important prerequisite for the success of new multimedia systems to offer optimal functionalities or capabilities. This is achieved by the employment of digital technologies and, in particular, computer technology. Examples for this are the applications offering an enhanced close-to-reality audiovisual impression. In previous audio systems, a substantial disadvantage lies in the quality of the spatial sound reproduction of natural, but also of virtual environments.

Methods of multi-channel loudspeaker reproduction of audio signals have been known and standardized for many years. All usual techniques have the disadvantage that both the site of the loudspeakers and the position of the listener are already impressed on the transmission format. With wrong arrangement of the loudspeakers with reference to the listener, the audio quality suffers significantly. Optimal sound is only possible in a small area of the reproduction space, the so-called sweet spot.

A better natural spatial impression as well as greater enclosure or envelope in the audio reproduction may be achieved with the aid of a new technology. The principles of this technology, the so-called wave field synthesis (WFS), have been studied at the TU Delft and first presented in the late 80s (Berkout, A. J.; de Vries, D.; Vogel, P.: Acoustic control by Wave field Synthesis. JASA 93, 1993).

Due to this method's enormous demands on computer power and transfer rates, the wave field synthesis has up to now only rarely been employed in practice. Only the progress in the area of the microprocessor technology and the audio encoding do permit the employment of this technology in concrete applications today. First products in the professional area are expected next year. In a few years, first wave field synthesis applications for the consumer area are also supposed to come on the market.

The basic idea of WFS is based on the application of Huygens' principle of the wave theory:

Each point caught by a wave is starting point of an elementary wave propagating in spherical or circular manner.

Applied on acoustics, every arbitrary shape of an incoming wave front may be replicated by a large amount of loudspeakers arranged next to each other (a so-called loudspeaker array). In the simplest case, a single point source to be reproduced and a linear arrangement of the loudspeakers, the audio signals of each loudspeaker have to be fed with a time delay and amplitude scaling so that the radiating sound fields of the individual loudspeakers overlay correctly. With several sound sources, for each source the contribution to each loudspeaker is calculated separately and the resulting signals are added. If the sources to be reproduced are in a room with reflecting walls, reflections also have to be reproduced via the loudspeaker array as additional sources. Thus, the expenditure in the calculation strongly depends on the number of sound sources, the reflection properties of the recording room, and the number of loudspeakers.

In particular, the advantage of this technique is that a natural spatial sound impression across a great area of the reproduction space is possible. In contrast to the known techniques, direction and distance of sound sources are reproduced in a very exact manner. To a limited degree, virtual sound sources may even be positioned between the real loudspeaker array and the listener.

Although the wave field synthesis functions well for environments the properties of which are known, irregularities occur if the property changes or the wave field synthesis is executed on the basis of an environment property not matching the actual property of the environment.

A property of the surrounding may also be described by the impulse response of the surrounding.

This will be set forth in greater detail on the basis of the subsequent example. It is assumed that a loudspeaker sends out a sound signal against a wall, the reflection of which is undesired. For this simple example, the space compensation using the wave field synthesis would consist in the fact that at first the reflection of this wall is determined in order to ascertain when a sound signal having been reflected from the wall again arrives the loudspeaker, and which amplitude this reflected sound signal has. If the reflection from this wall is undesirable, there is the possibility, with the wave field synthesis, to eliminate the reflection from this wall by impressing a signal with corresponding amplitude and of opposite phase to the reflection signal on the loudspeaker, so that the propagating compensation wave cancels out the reflection wave, such that the reflection from this wall is eliminated in the surrounding considered. This may be done by at first calculating the impulse response of the surrounding and then determining the property and position of the wall on the basis of the impulse response of this surrounding, wherein the wall is interpreted as a mirror source, i.e. as a sound source reflecting incident sound.

If at first the impulse response of this surrounding is measured and then the compensation signal, which has to be impressed on the loudspeaker in a manner superimposed on the audio signal, is calculated, cancellation of the reflection from this wall will take place, such that a listener in this surrounding has the sound impression that this wall does not exist at all.

However, it is crucial for optimum compensation of the reflected wave that the impulse response of the room is determined accurately so that no over- or undercompensation occurs.

Thus, the wave field synthesis allows for correct mapping of virtual sound sources across a large reproduction area. At the same time it offers, to the sound master and sound engineer, new technical and creative potential in the creation of even complex sound landscapes. The wave field synthesis (WFS, or also sound field synthesis), as developed at the TU Delft at the end of the 80s, represents a holographic approach of the sound reproduction. The Kirchhoff-Helmholtz integral serves as a basis for this. It states that arbitrary sound fields within a closed volume can be generated by means of a distribution of monopole and dipole sound sources (loudspeaker arrays) on the surface of this volume.

In the wave field synthesis, a synthesis signal for each loudspeaker of the loudspeaker array is calculated from an audio signal sending out a virtual source at a virtual position, wherein the synthesis signals are formed with respect to amplitude and phase such that a wave resulting from the superposition of the individual sound wave output by the loudspeakers present in the loudspeaker array corresponds to the wave that would be due to the virtual source at the virtual position if this virtual source at the virtual position were a real source with a real position.

Typically, several virtual sources are present at various virtual positions. The calculation of the synthesis signals is performed for each virtual source at each virtual position, so that typically one virtual source results in synthesis signals for several loudspeakers. As viewed from a loudspeaker, this loudspeaker thus receives several synthesis signals, which go back to various virtual sources. A superposition of these sources, which is possible due to the linear superposition principle, then results in the reproduction signal actually sent out from the loudspeaker.

The possibilities of the wave field synthesis can be utilized the better, the larger the loudspeaker arrays are, i.e. the more individual loudspeakers are provided. With this, however, the computation power the wave field synthesis unit must summon also increases, since channel information typically also has to be taken into account. In detail, this means that, in principle, a transmission channel of its own is present from each virtual source to each loudspeaker, and that, in principle, it may be the case that each virtual source leads to a synthesis signal for each loudspeaker, and/or that each loudspeaker obtains a number of synthesis signals equal to the number of virtual sources.

If the possibilities of the wave field synthesis particularly in movie theatre applications are to be utilized in that the virtual sources can also be movable, it can be seen that rather significant computation powers are to be handled due to the calculation of the synthesis signals, the calculation of the channel information and the generation of the reproduction signals through combination of the channel information and the synthesis signals.

Furthermore, it is to be noted at this point that the quality of the audio reproduction increases with the number of loudspeakers made available. This means that the audio reproduction quality becomes the better and more realistic, the more loudspeakers are present in the loudspeaker array(s).

In the above scenario, the completely rendered and analog-digital-converted reproduction signal for the individual loudspeakers could, for example, be transmitted from the wave field synthesis central unit to the individual loudspeakers via two-wire lines. This would indeed have the advantage that it is almost ensured that all loudspeakers work synchronously, so that no further measures would be needed for synchronization purposes here. On the other hand, the wave field synthesis central unit could be produced only for a particular reproduction room or for reproduction with a fixed number of loudspeakers. This means that, for each reproduction room, a wave field synthesis central unit of its own would have to be fabricated, which has to perform a significant measure of computation power, since the computation of the audio reproduction signals must take place at least partially in parallel and in real time, particularly with respect to many loudspeakers and/or many virtual sources.

German patent DE 10254404 B4 discloses a system as illustrated in FIG. 7. One part is the central wave field synthesis module 10. The other part consists of individual loudspeaker modules 12*a*, 12*b*, 12*c*, 12*d*, 12*e*, which are connected to actual physical loudspeakers 14*a*, 14*b*, 14*c*, 14*d*, 14*e*, such as it is shown in FIG. 1. It is to be noted that the number of the loudspeakers 14*a*-14*e* lies in the range above 50 and typically even significantly above 100 in typical applications. If a loudspeaker of its own is associated with each loudspeaker, the corresponding number of loudspeaker modules also is needed. Depending on the application, however, it is advantageous to address a small group of adjoining loudspeakers from a loudspeaker module. In this connection, it is arbitrary whether a loudspeaker module connected to four loudspeakers, for example, feeds the four loudspeakers with the same reproduction signal, or corresponding different synthesis signals are calculated for the four loudspeakers, so that such a loudspeaker module actually consists of several individual loudspeaker modules, which are, however, summarized physically in one unit.

Between the wave field synthesis module 10 and every individual loudspeaker 12*a*-12*e*, there is a transmission path 16*a*-16*e* of its own, with each transmission path being coupled to the central wave field synthesis module and a loudspeaker module of its own.

A serial transmission format providing a high data rate, such as a so-called Firewire transmission format or a USB data format, is advantageous as data transmission mode for transmitting data from the wave field synthesis module to a loudspeaker module. Data transfer rates of more than 100 megabits per second are advantageous.

The data stream transmitted from the wave field synthesis module 10 to a loudspeaker module thus is formatted correspondingly according to the data format chosen in the wave field synthesis module and provided with synchronization information provided in usual serial data formats. This synchronization information is extracted from the data stream by the individual loudspeaker modules and used to synchronize the individual loudspeaker modules with respect to their reproduction, i.e. ultimately to the analog-digital conversion for obtaining the analog loudspeaker signal and the sampling (re-sampling) provided for this purpose. The central wave field synthesis module works as a master, and all loudspeaker modules work as clients, wherein the individual data streams all obtain the same synchronization information from the central module 10 via the various transmission paths 16*a*-16*e*. This ensures that all loudspeaker modules work synchronously, namely synchronized with the master 10, which is important for the audio reproduction system so as not to suffer loss of audio quality, so that the synthesis signals calculated by the wave field synthesis module are not irradiated in temporally offset manner from the individual loudspeakers after corresponding audio rendering.

The concept described indeed provides significant flexibility with respect to a wave field synthesis system, which is scalable for various ways of application. But it still suffers from the problem that the central wave field synthesis module, which performs the actual main rendering, i.e. which calculates the individual synthesis signals for the loudspeakers depending on the positions of the virtual sources and depending on the loudspeaker positions, represents a "bottleneck" for the entire system. Although, in this system, the "post-rendering", i.e. the imposition of the synthesis signals with channel transmission functions, etc., is already performed in decentralized manner, and hence the necessary data transmission capacity between the central renderer module and the individual loudspeaker modules has already been reduced by selection of synthesis signals with less energy than a determined threshold energy, all virtual sources, however, still have to be rendered for all loudspeaker modules in a way, i.e. converted into synthesis signals, wherein the selection takes place only after rendering.

This means that the rendering still determines the overall capacity of the system. If the central rendering unit thus is capable of rendering 32 virtual sources at the same time, for example, i.e. to calculate the synthesis signals for these 32 virtual sources at the same time, serious capacity bottlenecks occur, if more than 32 sources are active at one time in one audio scene. For simple scenes this is sufficient. For more complex scenes, particularly with immersive sound impressions, i.e. for example when it is raining and many rain drops represent individual sources, it is immediately apparent that the capacity with a maximum of 32 sources will no longer suffice. A corresponding situation also exists if there is a large orchestra and it is desired to actually process every orchestral player or at least each instrument group as a source of its own at its own position. Here, 32 virtual sources may very quickly become too less.

One way of dealing with this problem of course consists in increasing the capacity of the renderer to more than 32 sources. It has turned out, however, that this may lead to a significant cost increase of the overall system, since very much needs to be invested in this additional capacity, and this additional capacity normally is not needed constantly, but only at certain "peak times" within an audio scene. Such an increase in capacity hence leads to a higher price, which can, however, only be explained to a customer with some difficulty, since the customer only very seldom makes use of the increased capacity.

SUMMARY OF THE INVENTION

According to an embodiment, an apparatus for providing data for the wave field synthesis rendering in a wave field synthesis system with a plurality of renderer modules, wherein at least one loudspeaker is associated with each renderer module, and wherein the loudspeakers associated with the renderers are attachable at different positions in a reproduction room, may have: a provider for providing a plurality of audio files, wherein a virtual source at a source position is associated with an audio file; and a data output for providing the audio file to a renderer with which a loudspeaker is associated that is to be active for the reproduction of the virtual source, wherein the data output is further formed to not provide the audio file to another renderer module if loudspeakers associated with the other renderer are not to be active for the reproduction of the source.

According to another embodiment, a method for providing data for the wave field synthesis rendering in a wave field synthesis system with a plurality of renderer modules, wherein at least one loudspeaker is associated with each renderer module, and wherein the loudspeakers associated with the renderers are attachable at different positions in a reproduction room, may have the steps of: providing a plurality of audio files, wherein a virtual source at a source position is associated with an audio file; and providing the audio file to a renderer with which a loudspeaker is associated that is to be active for the reproduction of the virtual source, wherein the audio file is not provided to another renderer module if loudspeakers associated with the other renderer are not to be active for the reproduction of the source.

According to another embodiment, a computer program may have program code for performing, when the program is executed on a computer, a method for providing data for the wave field synthesis rendering in a wave field synthesis system with a plurality of renderer modules, wherein at least one loudspeaker is associated with each renderer module, and wherein the loudspeakers associated with the renderers are attachable at different positions in a reproduction room, wherein the method may have the steps of: providing a plurality of audio files, wherein a virtual source at a source position is associated with an audio file; and providing the audio file to a renderer with which a loudspeaker is associated that is to be active for the reproduction of the virtual source, wherein the audio file is not provided to another renderer module if loudspeakers associated with the other renderer are not to be active for the reproduction of the source.

The present invention is based on the finding that an efficient data processing concept for the wave field synthesis is achieved by departing from the central renderer approach and instead employing several rendering units, which now do not have to bear the full processing load, but are controlled in intelligent manner, as opposed to a central rendering unit. In other words, each renderer module in a multi-renderer system only has a limited associated number of loudspeakers that must be supplied. According to the invention, it is determined, if the loudspeakers associated with a renderer module are active at all for this virtual source, by a central data output means already prior to rendering. Only if it is determined that the loudspeakers for a renderer are active when a virtual source is rendered, are the audio data for a virtual source transmitted together with necessary additionally information on this renderer, whereas the audio data on another renderer the loudspeakers of which are not active for rendering this virtual source is not transmitted.

Thus, it has turned out that there are very few virtual sources in which all loudspeakers in a loudspeaker array system reaching around a reproduction room are active, to play a virtual source. Thus, for a virtual source, e.g. in a four-array system, typically only two adjacent loudspeaker arrays or even only a single loudspeaker array are active, to represent this virtual source in the reproduction room.

According to the invention, this is already recognized prior to rendering, and only data actually needing it, i.e. that has loudspeakers on the output side that are supposed to represent the virtual source, is sent to the renderer.

With this, the amount of the data transfer is reduced as compared with known systems, since synthesis signals no longer have to be transmitted to loudspeaker modules, but only a file for an audio object from which the synthesis signals only then are derived for the individual (many) loudspeakers in decentralized manner.

On the other hand, the capacity of a system can be increased without problems in that several renderer modules are employed intelligently, where it has turned out that the provision of e.g. two 32-source renderer modules can be implemented in substantially more inexpensive and low-delay manner than if a 64-renderer module were developed at central location.

Moreover, it has turned out that the effective capacity of the system can already be almost doubled by provision of e.g. two 32-renderer modules, since virtual sources e.g. in a four-side array system normally only keep half the loudspeakers busy on average, while the other loudspeakers may in this case be fully loaded with other virtual sources each.

In an embodiment of the present invention, the renderer control can be done adaptively, in order to be able to still intercept greater transfer peaks. Here, a renderer module is not controlled automatically if at least one loudspeaker associated with this renderer module is active. Instead, a minimum threshold of active loudspeakers is default for a renderer, from which on a renderer only then is supplied with the audio file of a virtual source. This minimum number depends on the utilization (work-load) of this renderer. If it turns out that the utilization of this renderer already is at the critical limit or is very likely to soon be at the critical limit, which can be achieved on the basis of the look-ahead concept for the analysis in the scene description, the inventive data output means will control the anyway already strongly loaded renderer with a further virtual source only when a number of loudspeakers, which is above the variable minimum threshold, is supposed to be active for this further virtual source. This procedure is based on the fact that, although errors are introduced by omitting the rendering of a virtual source by a renderer, this introduced error is not that problematic due to the fact that this virtual source only keeps some loudspeakers of the renderer busy, namely as compared with a situation in which, when the renderer is busy with a relatively unimportant source, an important source coming later would have to be rejected completely.

BRIEF DESCRIPTION OF THE DRAWINGS

Embodiments of the present invention will be detailed subsequently referring to the appended drawings, in which.

DETAILED DESCRIPTION OF PREFERRED EMBODIMENTS

Figure 1:
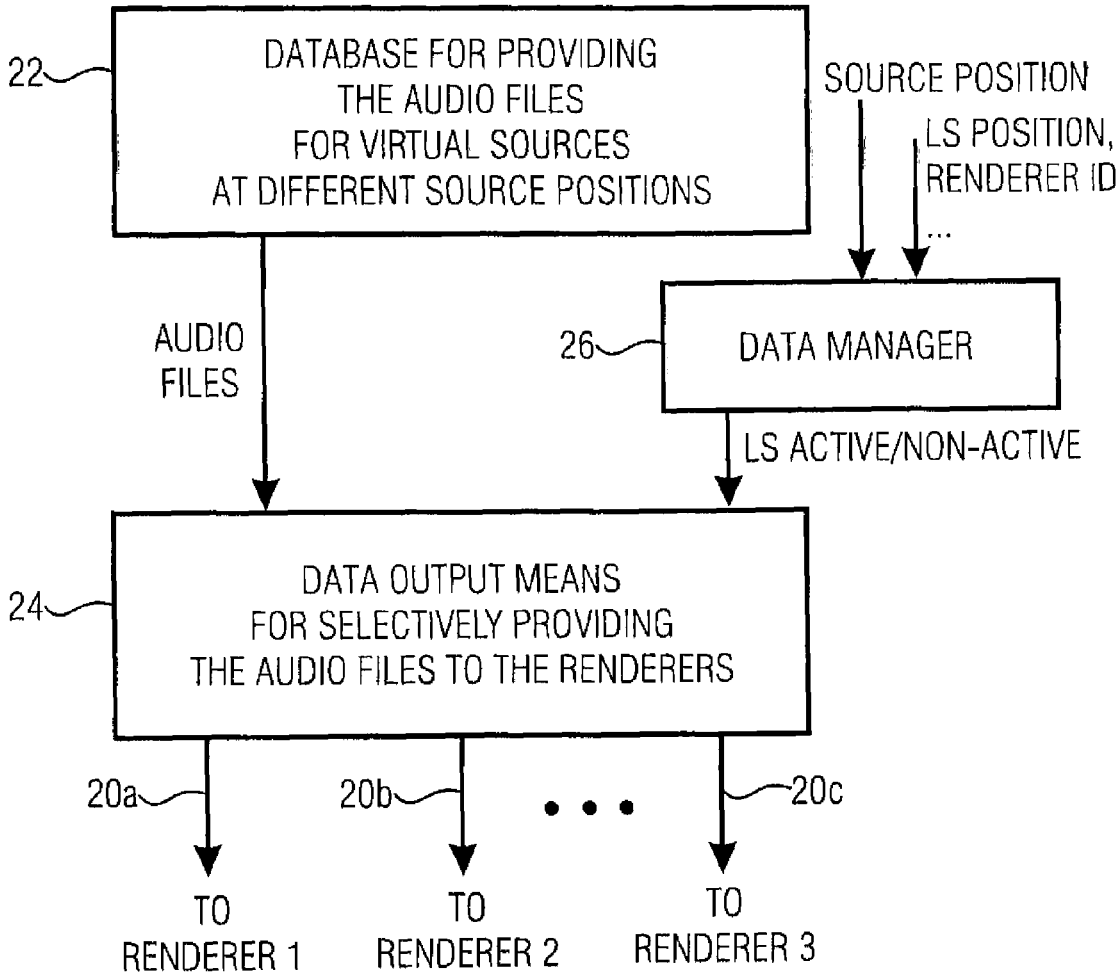
FIG. 1 is a block circuit diagram of an inventive apparatus for providing data for the wave field synthesis rendering.

FIG. 1 shows an apparatus for providing data for the wave field synthesis in a wave field synthesis system with a plurality of renderer modules attachable at outputs 20*a*, 20*b*, 20*c*. At least one loudspeaker is associated with each renderer module. Advantageously, however, systems with typically more than 100 loudspeakers altogether are used, so that at least 50 individual loudspeakers, which are attachable at different positions in a reproduction room as a loudspeaker array for the renderer module, might be associated with one renderer module.

The inventive apparatus further includes a means for providing a plurality of audio files, which is designated with 22 in FIG. 1. Advantageously, the means 22 is formed as a database for providing the audio files for virtual sources at different source positions. Furthermore, the inventive apparatus includes a data output means 24 for selectively providing the audio files to the renderers. In particular, the data output means 24 is formed to provide the audio files to a renderer only, and only if the renderer has associated with it a loudspeaker that is to be active for a reproduction of a virtual position, while the data output means is further formed so as to not provide the audio data to another renderer if all loudspeakers associated with the renderer are not supposed to be active for the reproduction of the source. As will be still explained later, depending on the implementation and particularly with respect to a dynamic load limitation, a renderer may not obtain an audio file even if it indeed has a few active loudspeakers, but the number of active loudspeakers lies below a minimum threshold as compared with the overall number of loudspeakers for this renderer.

Advantageously, the inventive apparatus further includes a data manager 26, which is formed to determine whether the at least one loudspeaker associated with a renderer should be active for the reproduction of a virtual source or not. Depending thereon, the data manager 26 controls the data output means 24 to distribute the audio files to the individual renderers or not. In one embodiment, the data manager 26 will in a way provide the control signal for a multiplexer in the data output means 24, so that the audio file is gated through to one or more outputs, but typically not all outputs 20*a*-20*c*.

Depending on the implementation, the data manager 26 and/or, if this functionality is integrated in the data output means 24, the data output means 24 may be active, in order to find out active renderers and/or non-active renderers on the basis of the loudspeaker positions or, if the loudspeaker positions are already unique from a renderer identification, on the basis of a renderer identification.

The present invention thus is based on an object-oriented approach, i.e. that the individual virtual sources are understood as objects characterized by an audio object and a virtual position in space and maybe by the type of source, i.e. whether it is to be a point source for sound waves or a source for plane waves or a source for sources of other shape.

As it has been set forth, the calculation of the wave fields is very computation-time intensive and bound to the capacities of the hardware used, such as soundcards and computers, in connection with the efficiency of the computation algorithms. Even the best-equipped PC-based solution thus quickly reaches its limits in the calculation of the wave field synthesis, when many demanding sound events are to be represented at the same time. Thus, the capacity limit of the software and hardware used gives the limitation with respect to the number of virtual sources in mixing and reproduction.

Figure 6:
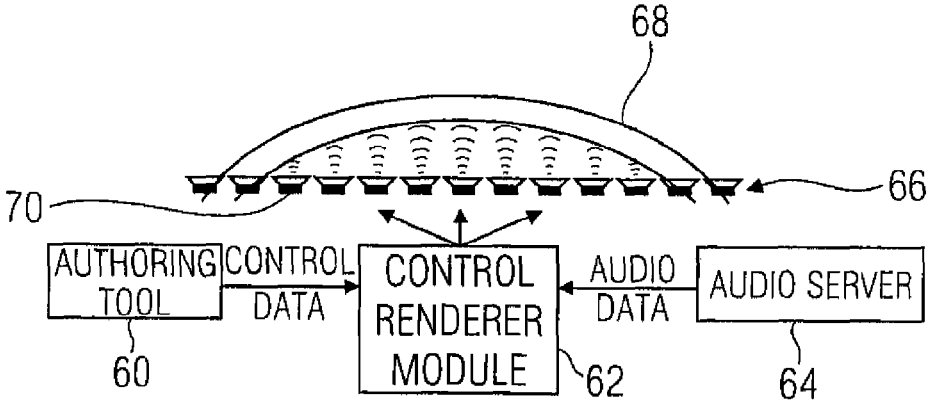
FIGURE 6 (PRIOR ART)
FIG. 6 is a schematic illustration of a known wave field synthesis concept.
Figure 7:
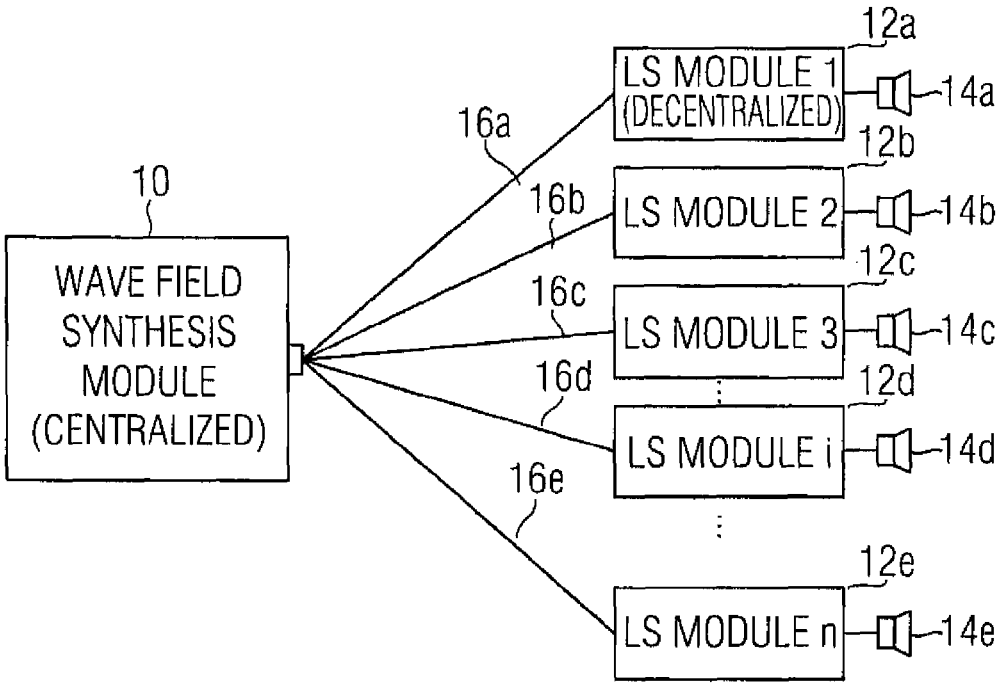
FIGURE 7 (PRIOR ART)
FIG. 7 is a further illustration of a known wave field synthesis concept.

FIG. 6 shows such a known wave field synthesis concept limited in its capacity, which includes an authoring tool 60, a control renderer module 62, and an audio server 64, wherein the control renderer module is formed to provide a loudspeaker array 66 with data, so that the loudspeaker array 66 generates a desired wave front 68 by superposition of the individual waves of the individual loudspeakers 70. The authoring tool 60 enables the user to create and edit scenes and control the wave-field-synthesis-based system. A scene thus consists of both information on the individual virtual audio sources and of the audio data. The properties of the audio sources and the references to the audio data are stored in an XML scene file. The audio data itself is filed on the audio server 64 and transmitted to the renderer module therefrom. At the same time, the renderer module obtains the control data from the authoring tool, so that the control renderer module 62, which is embodied in centralized manner, may generate the synthesis signals for the individual loudspeakers. The concept shown in FIG. 6 is described in "Authoring System for Wave Field Synthesis", F. Melchior, T. Röder, S. Brix, S. Wabnik and C. Riegel, AES Convention Paper, 115th AES convention, Oct. 10, 2003, New York.

If this wave field synthesis system is operated with several renderer modules, each renderer is supplied with the same audio data, no matter if the renderer needs this data for the reproduction due to the limited number of loudspeakers associated with the same or not. Since each of the current computers is capable of calculating 32 audio sources, this represents the limit for the system. On the other hand, the number of the sources that can be rendered in the overall system is to be increased significantly in efficient manner. This is one of the substantial prerequisites for complex applications, such as movies, scenes with immersive atmospheres, such as rain or applause, or other complex audio scenes.

According to the invention, a reduction of redundant data transmission processes and data processing processes is achieved in a wave field synthesis multi-renderer system, which leads to an increase in computation capacity and/or the number of audio sources computable at the same time.

For the reduction of the redundant transmission and processing of audio and meta data to the individual renderer of the multi-renderer system, the audio server is extended by the data output means, which is capable of determining which renderer needs which audio and meta data. The data output means, maybe assisted by the data manager, needs several pieces of information, in an embodiment. This information at first is the audio data, then time and position data of the sources, and finally the configuration of the renderers, i.e. information about the connected loudspeakers and their positions, as well as their capacity. With the aid of data management techniques and the definition of output conditions, an output schedule is produced by the data output means with a temporal and spatial arrangement of the audio objects. From the spatial arrangement, the temporal schedule and the renderer configuration, the data management module then calculates which sources are relevant for which renderers at a certain time instant.

Figure 5:
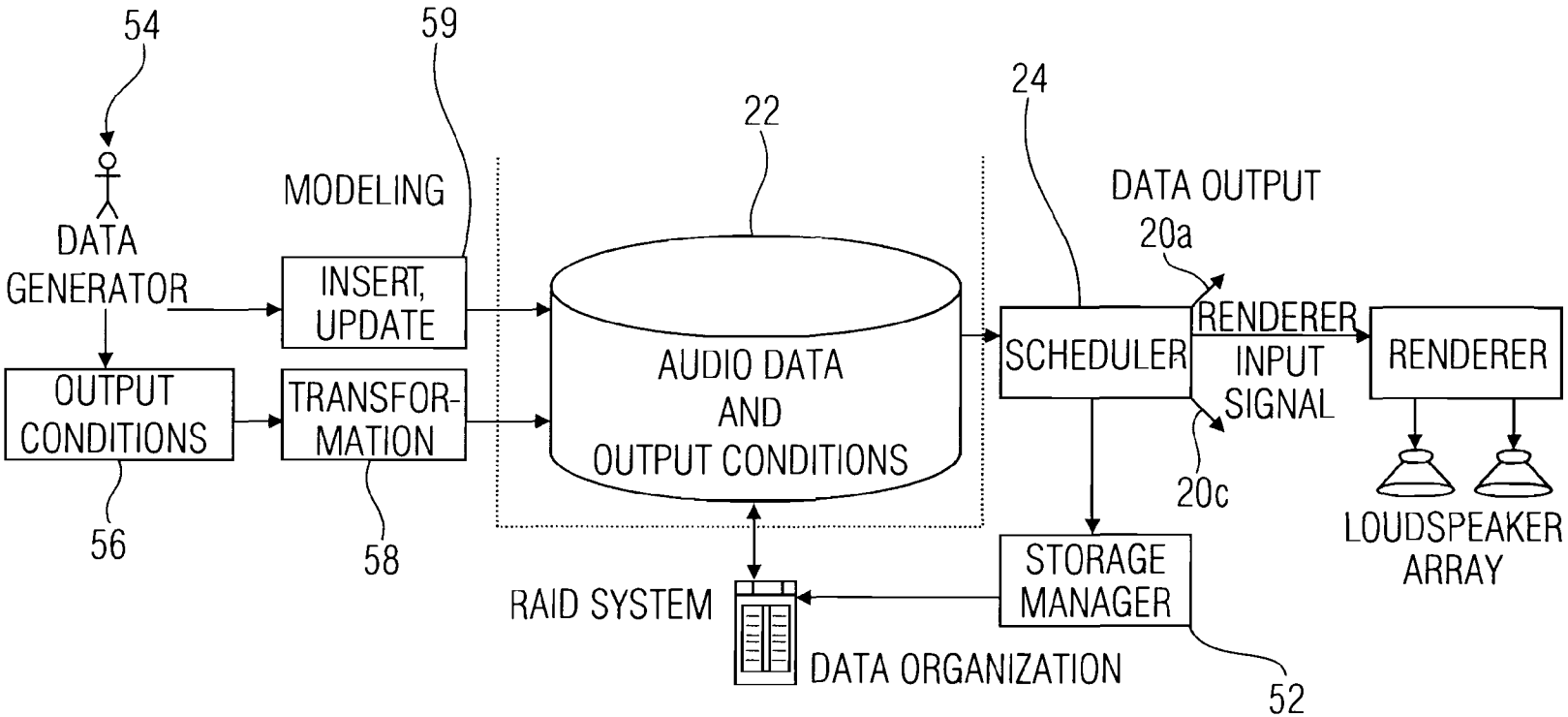
FIG. 5 shows an embedding of the inventive concept into an overall wave field synthesis system.

An advantageous overall concept is illustrated in FIG. 5. The database 22 is supplemented by the data output means 24 on the output side, wherein the data output means is also referred to as scheduler. This scheduler then generates the renderer input signals for the various renderers at its outputs 20*a*, 20*c*, so that the corresponding loudspeakers of the loudspeaker arrays are supplied.

Advantageously, the scheduler 24 also is assisted by a storage manager 52, in order to configure the database 42 by means of a RAID system and corresponding data organization defaults.

On the input side, there is a data generator 54, which may for example be a sound master or an audio engineer who is to model or describe an audio scene in object-oriented manner. Here, it gives a scene description including corresponding output conditions 56, which are then stored together with audio data in the database 22 after a transformation 58, if necessary. The audio data may be manipulated and updated by means of an insert/update tool 59.

Figure 2:
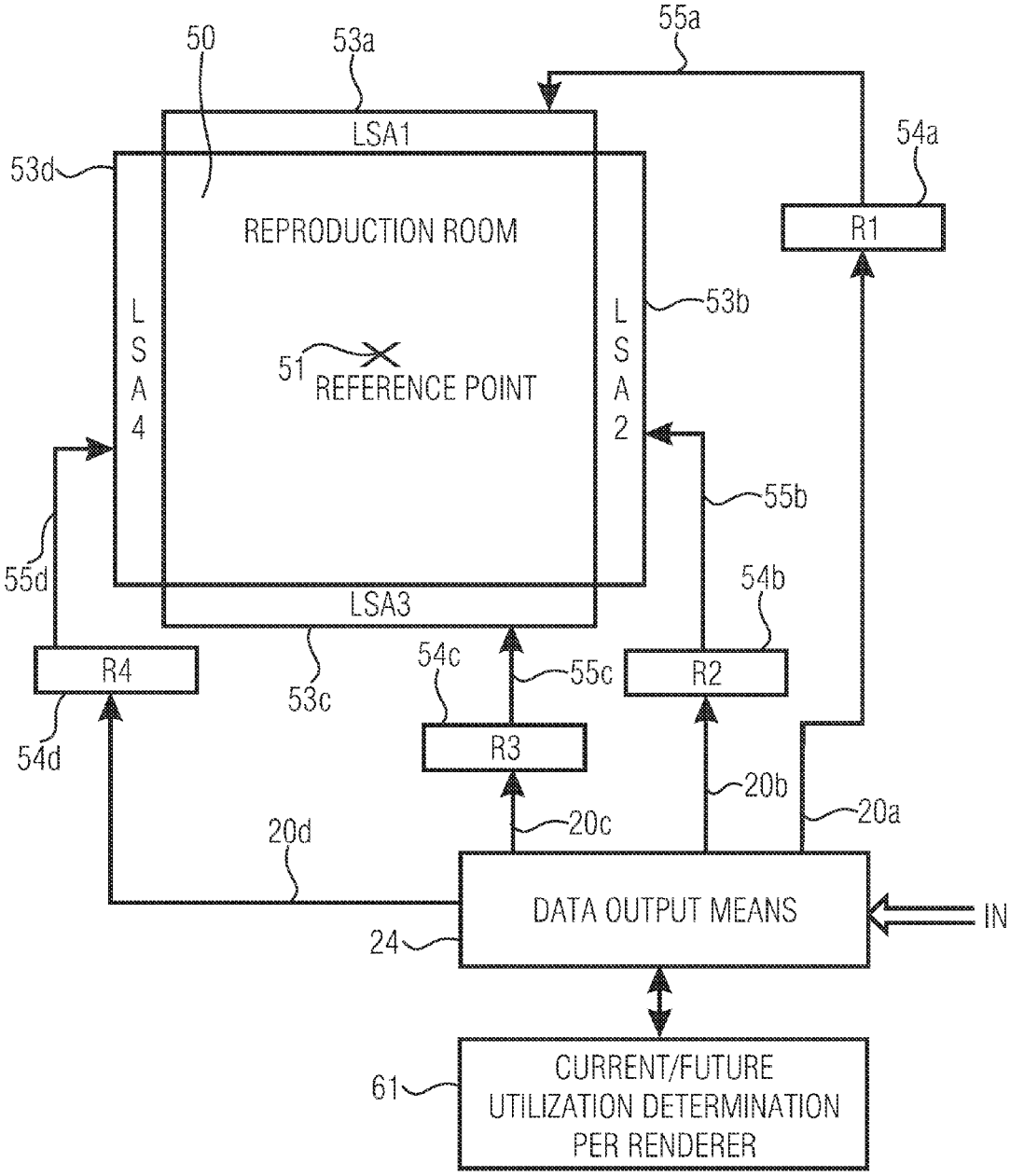
FIG. 2 is a block circuit diagram of an inventive embodiment with four loudspeaker arrays and four renderer modules.

Subsequently, with reference to FIGS. 2 to 4, it is gone into embodiments of the data output means 24 and/or the data manager 26, in order to perform the inventive selection, i.e. that various renderers only obtain the audio files when actually output at the end by the loudspeaker arrays associated with the renderers. Here, FIG. 2 shows an exemplary reproduction room 50 with a reference point 51, which lies at the center of the reproduction room 50 in an embodiment of the present invention. Of course, the reference point may, however, also be arranged at any other arbitrary location of the reproduction room, i.e. e.g. in the front third or in the rear third. Here, for example, it may be taken into account that audience in the front third of the reproduction room have paid a higher entrance fee than audience in the rear third of the reproduction room. In this case, it makes sense to put the reference point in the front third, since the audio impression at the reference point will be highest in terms of quality. In the embodiment shown in FIG. 2, four loudspeaker arrays LSA1 (53*a*), LSA2 (53*b*), LSA3 (53*c*) and LSA4 (53*d*) are arranged around the reproduction room 50. Each loudspeaker array is coupled to a renderer of its own R1 54*a*, R2 54*b*, R3 54*c* and R4 54*d*. Each renderer is connected to its loudspeaker array via a renderer-loudspeaker-array connection line 55*a*, 55*b*, 55*c* and 55*d*, respectively.

Furthermore, each renderer is connected to an output 20*a*, 20*b*, 20*c* or 20*d* of the data output means 24. The data output means receives, on the input side, i.e. via its input IN, the corresponding audio files as well as control signals from a advantageously provided data manager 26 (FIG. 1), which indicate whether a renderer is to obtain an audio file or not, i.e. whether associated loudspeakers are to be active for a renderer or not. In detail, the loudspeakers of the loudspeaker array 53*a*, for example, are associated with the renderer 54*a*, but not with the renderer 54*d*. The renderer 54*d* has the loudspeakers of the loudspeaker array 53*d* as associated loudspeakers, as can be seen in FIG. 2.

It is to be pointed out that the individual renderers communicate synthesis signals for the individual loudspeakers via the renderer/loudspeaker connection lines 55*a*, 55*b*, 55*c* and 55*d*. But since data amounts are large here if a great number of loudspeakers is present in a loudspeaker array, it is advantageous to arrange the renderers and loudspeakers in close spatial proximity.

In contrast, this prerequisite for the arrangement of the data output means 24 and of the renderers 54*a*, 54*b*, 54*c*, 54*d* with respect to each other is not critical, since the data traffic via the outputs 20*a*, 20*b*, 20*c*, 20*d* and the data output means/renderer lines associated with these outputs is limited. In detail, here only audio files and information on the virtual sources associated with the audio files are transmitted. The information on the virtual sources includes at least the source position and temporal indications on the source, i.e. when the source begins, how long it takes and/or when it ends again. Advantageously, also further information relating to the type of virtual source is transmitted, i.e. whether the virtual source is supposed to be point source or a source for plane waves or a source for differently "shaped" sound waves.

Depending on the implementation, the renderers may also be supplied with information on acoustics of the reproduction room 50 as well as information on actual properties of the loudspeakers in the loudspeaker arrays, etc. This information does not necessarily have to be transferred via the lines 20*a*-20*d*, but may also be supplied to the renderers R1-R4 in another way, so that these can calculate synthesis signals tailored to the reproduction room, which are then fed to the individual loudspeakers. Furthermore, it is to be pointed out that the synthesis signals, which are calculated by the renderers for the individual loudspeakers, already are superimposed synthesis signals if several virtual sources have been rendered by a renderer at the same time, since each virtual source will lead to a synthesis signal for a loudspeaker of an array, wherein the final loudspeaker signal then is obtained after the superposition of the synthesis signals of the individual virtual sources by addition of the individual synthesis signals.

The embodiment shown in FIG. 2 further includes a utilization determination means 61 in order to post-process the control of renderer with an audio file depending on a current actual renderer utilization or an estimated or predicted future renderer utilization.

Thus, the capacity of each renderer 54*a*, 54*b*, 54*c* and 54*d* of course is limited. If each of these renderers is for example capable of processing a maximum of 32 audio sources, and the utilization determination means 61 determines that e.g. the renderer R1 already is rendering e.g. 30 sources, there is a problem in that, when two further virtual sources are to be rendered in addition to the other 30 sources, the capacity limit of the renderer 54*a* is reached.

Thus, the basic rule actually is that the renderer 54*a* obtains an audio file when it has been determined that at least one loudspeaker is to be active for reproducing a virtual source. But it could be the case that it is determined that only a small proportion of the loudspeakers in the loudspeaker array 53*a* is active for a virtual source, such as only 10% of all loudspeakers belonging to the loudspeaker array. In this case, the utilization determination means 61 would decide that this renderer is not supplied with the audio file determined for this virtual source. With this, an error is introduced. But the error is not particularly grave due to the small amount of loudspeakers of the array 53*a*, since it is assumed that this virtual source is additionally rendered by adjacent arrays, namely probably with a substantially greater number of loudspeakers for these arrays. The suppression of the rendering or irradiation of this virtual source by the loudspeaker array 53*a* will thus lead to a position shift, which does however, due to the small amount of loudspeakers, not have such a strong effect and in any case is substantially less important than if the renderer 54*a* had to be disabled completely due to overload, although it would be rendering a source keeping e.g. all loudspeakers of the loudspeaker array 53*a* busy.

Subsequently, with reference to FIG. 3A, an embodiment of the data manager 26 of FIG. 1 will be illustrated, which is formed to determine whether loudspeakers associated with an array are to be active depending on a certain virtual position or not. Advantageously, the data manager works without complete rendering, but determines the active/non-active loudspeakers, and hence the active and/or non-active renderers, without calculation of synthesis signals, but solely due to the source positions of the virtual sources and the position of the loudspeakers and/or, since the position of the loudspeakers are already fixed by the renderer identification in an array design, due to the renderer identification.

Figures 3A, 3B:
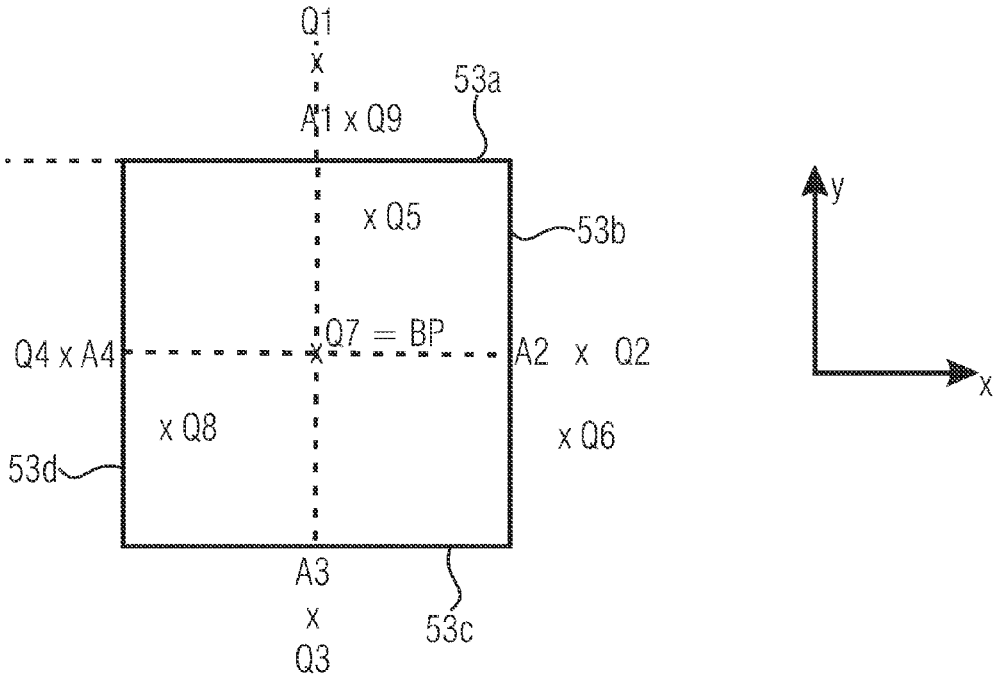
FIGS. 3A and 3B are a schematic illustration of a reproduction room with a reference point and various source positions and active and non-active loudspeaker arrays.

Thus, in FIG. 3A, various source positions Q1-Q9 are drawn in, whereas in FIG. 3B it is indicated in tabular manner which renderer A1-A4 is active (A) or non-active (NA) for a certain source position Q1-Q9 or e.g. is active or non-active depending on the current utilization.

For example, if the source position Q1 is considered, it can be seen that this source position is behind the front loudspeaker array 53*a* with reference to the observation point OP. The listener at the observation point would like to experience the source at the source position Q1 such that the sound in a way comes "from the front". For this reason, the loudspeaker arrays A2, A3 and A4 do not have to emit any sound signals due to the virtual source at the source position Q1, so that they are non-active (NA), as it is drawn in the corresponding column in FIG. 3B. This correspondingly applies to the situation for the sources Q2, Q3 and Q4, but for the other arrays.

The source Q5, however, is offset both in x direction and y direction with reference to the observation point. For this reason, both the array 53*a* and the array 53*b*, but not the arrays 53*c* and 53*d*, are needed for positionally exact reproduction of the source at the source position Q5.

This correspondingly applies to the situation for the source Q6, the source Q8 and, if no utilization problems exist, the source Q9. Here, it is unimportant whether a source is behind the array (Q6) or in front of the array (Q5), as may for example be seen through comparison of the sources Q6 and Q5.

If a source position coincides with the reference point, such as drawn for the source Q7, for example, it is advantageous that all loudspeaker arrays be active. According to the invention, as compared with known systems, in which all renderers have been controlled with all audio files, hence no advantage is obtained for such a source. It can be seen, however, that a significant advantage is achieved for all other source positions. As such, for the sources Q1, Q2, Q3, computation capacity and data transmission savings of 75% are achieved, while for the sources arranged within a quadrant, such as Q5, Q6 and Q8, still savings of 50% are obtained.

Furthermore, from FIG. 3*a* it can be seen that the source Q9 is arranged only slightly off the direct connection line between the reference point and the first array 53*a*. If the source Q9 were only reproduced by the array 53*a*, the observer at the reference point would only experience the source Q9 on the connection line and not slightly offset. This only "slight offset" leads to the fact that only few loudspeakers are to be active in the loudspeaker array 53*b*, or the loudspeakers only emit signals with very little energy. So as to spare the renderer associated with the array A2, when it is already strongly loaded, or still keep capacities ready there if a source comes up, such as the source Q2 or Q6, which must be rendered by the array A2 in any case, it therefore is advantageous to switch the array A2 non-active, as it is illustrated in the last column of FIG. 3B.

According to the invention, the data manager 26 thus will be formed, in an embodiment, to determine a loudspeaker in the array to be active if the source position is between the reference point and the loudspeaker, or the loudspeaker between the source position and the reference point. The first situation is illustrated for the source Q5, while the second situation is illustrated for the source Q1, for example.

Figure 4:
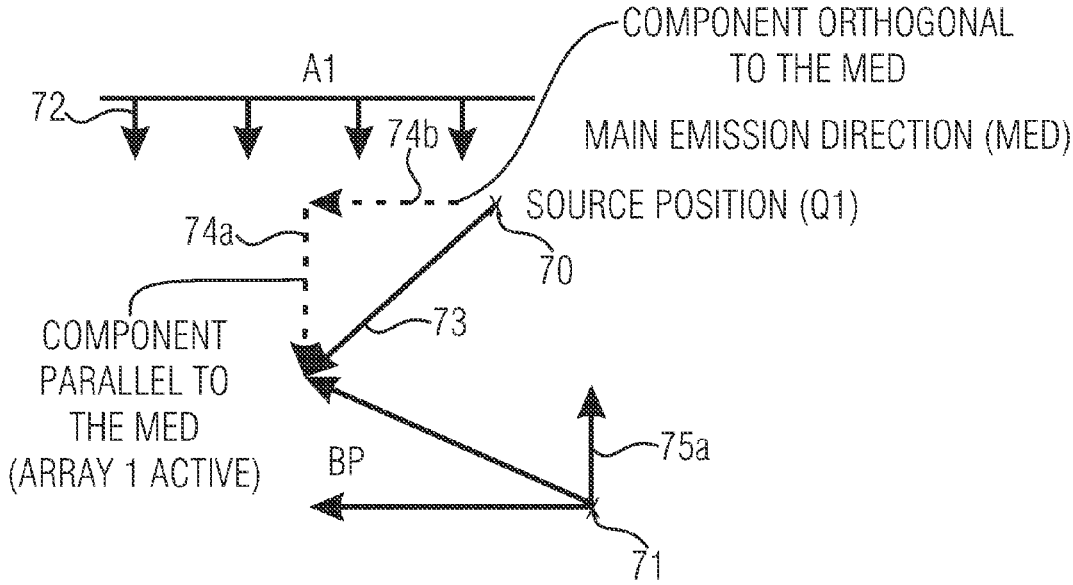
FIG. 4 is a schematic depiction for determining active loudspeakers on the basis of the main emission direction of the loudspeakers.

FIG. 4 shows a further embodiment for the determination of active and non-active loudspeakers. Two source positions 70 and 71 are considered, wherein the source position 70 is the first source position and the source position 71 is the second source position (Q2). Furthermore, a loudspeaker array A1 is considered, which has loudspeakers having a main emission direction (MED), which is directed perpendicularly away from a longitudinal extension of the array, as indicated by emission direction arrows 72, in the embodiment shown in FIG. 4.

So as to determine whether the loudspeaker array is to be active for source positions or not, now a distance from the source position Q1 to the reference point, which is designated with 73, is subjected to orthogonal decomposition, in order to find a component 74*a* parallel to the main emission direction 72 and a component 74*b* orthogonal to the main emission direction of the distance 73. From FIG. 4, it can be seen that such a component 74*a* parallel to the main emission direction exists for the source position Q1, while a corresponding component of the source position Q2 directed in y direction, which is designated with 75*a*, is not directed in parallel, but opposite to the main emission direction. The array A1 will thus be active for a virtual source at the source position Q1, whereas the array A1 need not be active for a source at the source position Q2, and hence also need not be supplied with an audio file.

From the two embodiments in FIGS. 3A and 4, it can be seen that the only parameters that are variable are the source positions, whereas the reference point and the main emission direction of the array loudspeakers and/or the positioning of the arrays, and hence the positioning of the loudspeakers in the arrays, typically will be fixed. Hence, it is advantageous to perform a complete calculation according to FIGS. 3A, 3B or FIG. 4 not for each source position. Instead, according to the invention, a table is provided, which gets a source position in a coordinate system related to the reference point on the input side and provides an indication as to whether this loudspeaker array is to be active for the current source position or not, for each loudspeaker array on the output side. With this, through a simple and quick table lookup, a very efficient and low-in-effort implementation of the data manager 26 and/or the data output means 24 can be achieved.

At this point, it is to be pointed out that other array configurations may of course also be present. As such, the inventive concept will already lead to significant improvement if e.g. only two loudspeaker arrays are present in the reproduction room, such as the two loudspeaker arrays 53*b* and 53*d* of FIG. 2. Furthermore, the inventive concept also is applicable to differently shaped arrays, such as for hexagonally arranged arrays, or for arrays that are not linear or flat, but e.g. are curved.

Furthermore, it is to be pointed out that the inventive concept also is employable if only a single linear e.g. front array exists in a reproduction room, but if this front array is controlled by various renderers, with a renderer serving a certain section of the array. In this case, there will also arise a situation in which for example a source with a virtual position on the far left with respect to the wide front array does not need the loudspeakers to the far right of the front array to play.

Depending on the conditions, the inventive method may be implemented in hardware or in software. The implementation may be on a digital storage medium, particularly a floppy disk or CD, with electronically readable control signals capable of cooperating with a programmable computer system so that the method is executed. In general, the invention thus also consists in a computer program product with program code stored on a machine-readable carrier for performing the method, when the computer program product is executed on a computer. In other words, the invention may thus also be realized as a computer program with program code for performing the method, when the computer program is executed on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for providing data for the wave field synthesis rendering in a wave field synthesis system, comprising:

a provider for providing a plurality of audio files, wherein a virtual source at a source position is associated with an audio file; and a data output for providing the audio file to a first renderer module with which a loudspeaker is associated that is to be active for the reproduction of the virtual source, wherein the data output is further formed to not provide the audio file to a second renderer module; wherein loudspeakers associated with the second renderer module are not to be active for the reproduction of the virtual source;

the wave field synthesis system comprises the first renderer module and the second renderer module;

at least one loudspeaker is associated with each of the first renderer module and the second renderer module;

the loudspeakers associated with first renderer module and the second renderer module are attachable at different positions in a reproduction room; and each of the first renderer module and the second renderer module comprises a certain maximum processing capacity, and wherein the data output is formed to provide an audio file to one of the first renderer module and the second renderer module only when a minimum proportion of the loudspeakers associated with the one of the first renderer module or the second renderer module has been determined to be active, wherein the minimum proportion is variable and depends on a utilization of the first renderer module or the second renderer module, which can be determined by a utilization determinator.

2. The apparatus according to claim 1, further comprising:

a data manager for determining whether the at least one loudspeaker associated with the first renderer module or the second renderer module is to be active for the reproduction of the virtual source or not, wherein the data manager is formed to perform the determination based on the source position and a loudspeaker position or a renderer module identification.

3. The apparatus according to claim 2, wherein the reproduction room comprises a reference point, wherein the data manager is formed to determine a loudspeaker to be active if the source position is between the reference point and the loudspeaker, or if the loudspeaker is between the source position and the reference point.

4. The apparatus according to claim 2, wherein the data manager is formed to determine a loudspeaker to be active if an angle between a first line from the source position to the reference point and a second line from the loudspeaker to the reference point lies between 0° and 90°.

5. The apparatus according to claim 2, wherein the data manager is formed to determine a loudspeaker to be non-active if a connection line from the source position to the reference point does not comprise any directional components parallel to a main sound emission direction of the loudspeaker.

6. The apparatus according to claim 1, wherein several loudspeakers are associated with the first renderer module or the second renderer module, and wherein the data output is formed to supply the first renderer module or the second renderer module with the audio file only if more than 10% of the loudspeakers associated with the first renderer module or the second renderer module have been determined to be active, or if the loudspeakers associated with the first renderer module or the second renderer module would provide, for a virtual source, a synthesis signal with an amplitude higher than a minimum threshold.

7. The apparatus according to claim 1, wherein several loudspeakers are associated with the first renderer module or the second renderer module, and wherein the first renderer module or the second renderer module is supplied with an audio file only if at least one loudspeaker associated with the first renderer module or the second renderer module has been determined to be active.

8. The apparatus according to claim 1, wherein the data output is formed to increase a minimum proportion if the utilization determined by the utilization determinator increases.

9. The apparatus according to claim 1, wherein the utilization determinator is formed to determine a current or estimated future utilization.

10. The apparatus according to claim 1, wherein the data output comprises a lookup table, which is formed to receive a source position as input quantity, and which is formed to provide, as output quantity for the first renderer module and the second renderer module, information as to whether the first renderer module or the second renderer module for the source position input on the input side is to be active or not.

11. The apparatus according to claim 1, wherein the data output is formed to provide the audio file for a virtual source, a source position for the virtual source, and information on beginning, end and/or duration of the virtual source in an audio scene to the first renderer module or the second renderer module with which an active loudspeaker is associated.

12. A method for providing data for the wave field synthesis rendering in a wave field synthesis system, comprising:

providing a plurality of audio files, wherein a virtual source at a source position is associated with an audio file; and providing the audio file, by a data output, to a first renderer module with which a loudspeaker is associated that is to be active for the reproduction of the virtual source, wherein the audio file is not provided to a second renderer module; wherein loudspeakers associated with the second renderer module are not to be active for the reproduction of the virtual source;

the wave field synthesis system comprises the first renderer module and the second renderer module;

at least one loudspeaker is associated with each of the first renderer module and the second renderer module;

the loudspeakers associated with the first renderer module and the second renderer module are attachable at different positions in a reproduction room; and each renderer module comprises a certain maximum processing capacity, and wherein the data output is formed to provide an audio file to the first or the second renderer only when a minimum proportion of the loudspeakers associated with the first or the second renderer module has been determined to be active, wherein the minimum proportion is variable and depends on a utilization of the first or the second renderer module, which can be determined by a utilization determination operation.

13. A non-transitory storage medium having stored thereon a computer program with program code for performing, when the program is executed on a computer, a method for providing data for the wave field synthesis rendering in a wave field synthesis system, the method comprising:

providing a plurality of audio files, wherein a virtual source at a source position is associated with an audio file; and providing the audio file, by a data output, to a first renderer module with which a loudspeaker is associated that is to be active for the reproduction of the virtual source, wherein the audio file is not provided to a second renderer module; wherein loudspeakers associated with the second renderer module are not to be active for the reproduction of the virtual source;

the wave field synthesis system comprises the first renderer module and the second renderer module;

at least one loudspeaker is associated with each of the first renderer module and the second renderer module;

the loudspeakers associated with the first renderer module and the second renderer module are attachable at different positions in a reproduction room; and each renderer module comprises a certain maximum processing capacity, and wherein the data output is formed to provide an audio file to the first or the second renderer only when a minimum proportion of the loudspeakers associated with the first or the second renderer module has been determined to be active, wherein the minimum proportion is variable and depends on a utilization of the first or the second renderer module, which can be determined by a utilization determination operation.

14. An apparatus for providing data for the wave field synthesis rendering in a wave field synthesis system, comprising:

a provider for providing a plurality of audio files, wherein a virtual source at a source position is associated with an audio file; and a data output for providing the audio file to a first renderer module with which a loudspeaker is associated that is to be active for the reproduction of the virtual source, wherein the data output is further formed to not provide the audio file to a second renderer module, wherein loudspeakers associated with the second renderer module are not to be active for the reproduction of the virtual source; wherein the wave field synthesis system comprises the first renderer module and the second renderer module, wherein at least one loudspeaker is associated with each renderer module, and wherein the loudspeakers associated with the renderer modules are attachable at different positions in a reproduction room; and the data output is formed to further provide information on a type of the virtual source to the first or the second renderer module, the information on the type of the virtual source indication, whether the virtual source is a point source, whether the virtual source is a source for plane waves or whether the virtual source is a source for waves of another shape.

15. A method for providing data for the wave field synthesis rendering in a wave field synthesis system, comprising:

providing a plurality of audio files, wherein a virtual source at a source position is associated with an audio file; and providing, by a data output, the audio file to a first renderer module with which a loudspeaker is associated that is to be active for the reproduction of the virtual source, wherein the audio file is not provided to a second renderer module; wherein loudspeakers associated with the second renderer are not to be active for the reproduction of the virtual source;

the wave field synthesis system comprises the first renderer module and the second renderer module, wherein at least one loudspeaker is associated with each renderer module, and wherein the loudspeakers associated with the renderer modules are attachable at different positions in a reproduction room; and the data output is formed to further provide information on a type of the virtual source to the first or the second renderer module, the information on the type of the virtual source indication, whether the virtual source is a point source, whether the virtual source is a source for plane waves or whether the virtual source is a source for waves of another shape.

16. A non-transitory storage medium having stored thereon a computer program with program code for performing, when the program is executed on a computer, a method for providing data for the wave field synthesis rendering in a wave field synthesis system, the method comprising:

providing a plurality of audio files, wherein a virtual source at a source position is associated with an audio file; and providing, by a data output, the audio file to a first renderer module with which a loudspeaker is associated that is to be active for the reproduction of the virtual source, wherein the audio file is not provided to a second renderer module, wherein loudspeakers associated with the second renderer module are not to be active for the reproduction of the virtual source; wherein the wave field synthesis system comprises the first renderer module and the second renderer module, wherein at least one loudspeaker is associated with each renderer module, and wherein the loudspeakers associated with the renderer modules are attachable at different positions in a reproduction room; and the data output is formed to further provide information on a type of the virtual source to the first or the second renderer module, the information on the type of the virtual source indication, whether the virtual source is a point source, whether the virtual source is a source for plane waves or whether the virtual source is a source for waves of another shape.

* * * * *